US007415783B2

(12) United States Patent
Huffman et al.

(10) Patent No.: US 7,415,783 B2
(45) Date of Patent: Aug. 26, 2008

(54) BOOM SUPPORT STRAND OSCILLATION DAMPENING MECHANISM

(75) Inventors: Joseph L. Huffman, Mukwonago, WI (US); Harvey J. Kallenberger, Wind Lake, WI (US); Rikos A. Kasim, Mukwonago, WI (US)

(73) Assignee: Harnischfeger Technologies, Inc., Wilmington, DE (US)

( * ) Notice: Subject to any disclaimer, the term of this patent is extended or adjusted under 35 U.S.C. 154(b) by 533 days.

(21) Appl. No.: 11/177,021

(22) Filed: Jul. 8, 2005

(65) Prior Publication Data

US 2007/0020072 A1 Jan. 25, 2007

(51) Int. Cl.
*E02F 3/60* (2006.01)

(52) U.S. Cl. ..... 37/399; 37/397; 37/401; 212/272

(58) Field of Classification Search ..... 37/394–401; 212/272–275

See application file for complete search history.

(56) References Cited

U.S. PATENT DOCUMENTS 2,267,614 A * 12/1941 Martinson ..... 37/396
3,643,285 A * 2/1972 Modrey ..... 15/246.5
3,681,808 A * 8/1972 Hahn et al. ..... 24/115 R
3,877,581 A * 4/1975 Auxer ..... 212/195
4,172,529 A * 10/1979 Bryan, Jr. ..... 212/288
4,204,664 A * 5/1980 Bryan, Jr. ..... 254/288
4,787,524 A * 11/1988 Cobb et al. ..... 212/278
4,805,707 A * 2/1989 Davis et al. ..... 173/210
5,249,379 A * 10/1993 Baker et al. ..... 37/357
5,343,641 A * 9/1994 Gregory ..... 37/397
5,367,798 A * 11/1994 Hughes ..... 37/399
6,067,734 A * 5/2000 Kallenberger ..... 37/395
6,067,735 A * 5/2000 Kallenberger ..... 37/397
6,446,366 B1 * 9/2002 Briscoe et al. ..... 37/398
6,588,126 B2 * 7/2003 Leslie et al. ..... 37/394

* cited by examiner

*Primary Examiner*—Thomas A Beach
(74) *Attorney, Agent, or Firm*—James Earl Lowe, Jr.

(57) ABSTRACT

An apparatus including a main housing including a generally horizontal platform, a boom extending from the platform, a bucket suspended from the boom, and a mast extending from the platform. The apparatus further includes a boom support strand extending between and attached to the mast and the boom, and a boom support strand oscillation dampening mechanism. The boom support strand oscillation dampening mechanism comprises a left brace and a right brace spaced apart from the left brace, and a polyester rope extending between each of the braces and the boom. Each of the ropes is attached to the boom. A device attaches the rope to the brace, and a boom support strand clamp mechanism is connected to the brace and includes a first clamp block, a second clamp block, and a flexible enclosure placed between the first clamp block and the second clamp block. The boom support strand is within the flexible enclosure, and the flexible enclosure has a length, as measured from its midsection to either end of the flexible enclosure, of more than 2 times longer than the inside diameter of the flexible enclosure. A mechanism holds the first clamp block to the second clamp block so that the flexible enclosure is clamped between the first clamp block and the second clamp block.

14 Claims, 4 Drawing Sheets

BOOM SUPPORT STRAND OSCILLATION DAMPENING MECHANISM

BACKGROUND OF THE INVENTION

This invention is directed to an apparatus having support strands extending between a mast and a boom, and, more particularly, to a mechanism for reducing oscillations of such support strands.

SUMMARY OF THE INVENTION

This invention is an apparatus including a main housing including a generally horizontal platform, a boom extending from the platform, a bucket suspended from the boom, and a mast extending from the platform. The apparatus further includes a boom support strand extending between and attached to the mast and the boom, and a boom support strand oscillation dampening mechanism. The boom support strand oscillation dampening mechanism comprises a left brace and a right brace spaced apart from the left brace, and a polyester rope extending between each of the braces and the boom. Each of the ropes is attached to the boom. A device attaches the rope to the brace, and a boom support strand clamp mechanism is connected to the brace and includes a first clamp block, a second clamp block, and a flexible enclosure placed between the first clamp block and the second clamp block. The boom support strand is within the flexible enclosure, and the flexible enclosure has a length, as measured from its midsection to either end of the flexible enclosure, of more than 2 times longer than the inside diameter of the flexible enclosure. A mechanism holds the first clamp block to the second clamp block so that the flexible enclosure is clamped between the first clamp block and the second clamp block.

One of the principal objects of the invention is to provide an improved boom strand oscillation damping mechanism that is less subject to wear damage and that is effective at damping boom oscillations without damaging the boom strand.

Figure 1:
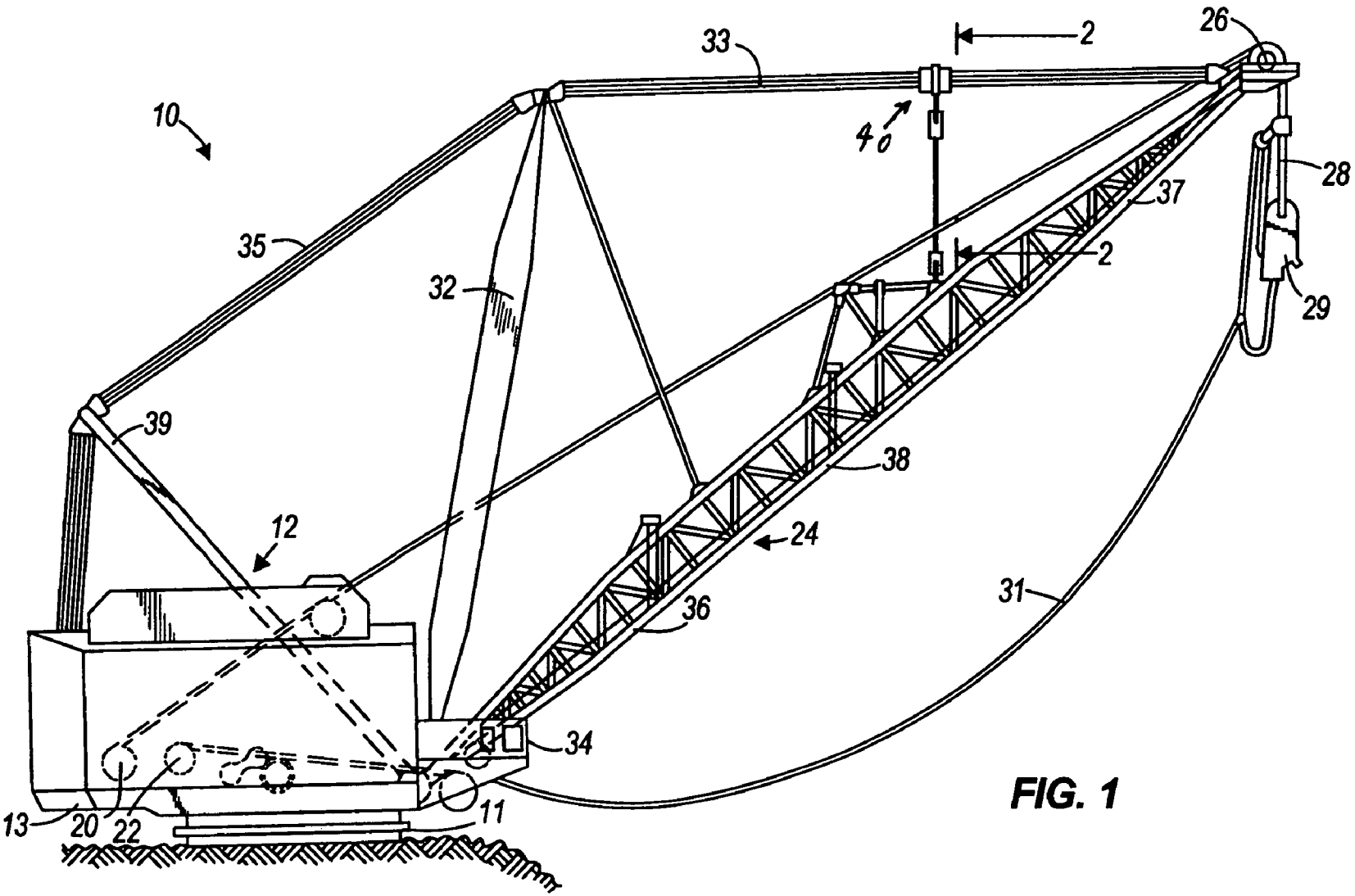
FIG. 1 is a side elevational view of a dragline including a boom support strand oscillation dampening mechanism of the invention.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Further, it is to be understood that such terms as "forward", "rearward", "left", "right", "upward" and "downward", etc., are words of convenience in reference to the drawings and are not to be construed as limiting terms.

DETAILED DESCRIPTION OF THE PREFERRED EMBODIMENT

The invention is directed to a machine for lifting heavy loads. One such machine is an industrial crane. In this embodiment, a walking dragline 10 embodying the invention is illustrated in the drawings.

As illustrated in FIG. 1, the dragline 10 includes a main housing 12 including a generally horizontal platform 13. A boom 24 extends from the platform 13, and a bucket 29 is suspended from the boom 24. The boom 24 includes a lower section 36, an upper section 37, and a center section 38 intermediate the lower and upper sections 36 and 37. In the illustrated embodiment, the boom 24 is rectangular in cross-section. The dragline 10 also includes a conventional mast assembly 32 that extends from the platform 13, and a set of four-boom support strands or lines 33 (see FIGS. 1, 2, 3 and 4) extends between and are attached to the upper ends of the boom 24 and the mast 32. A set of four mast support strands 35 also extends between and is attached to the upper end of the mast 32 and the platform by a conventional support structure. The dragline 10 also comprises a bucket hoist mechanism 20 and a bucket drag mechanism 22, both of which are mounted in the main housing 12.

The boom 24 extends upwardly and outwardly from the main housing 12. The upper end of the boom 24 has thereon a sheave 26 that is rotatable about a horizontal axis. A hoist rope 28 extends between the bucket hoist mechanism 20 and over the sheave 26 to means for engaging or lifting a load, such as the bucket 29, to permit vertical movement of the bucket 29 relative to the boom 24. A drag rope 31 extends from the bucket drag mechanism 22 to the bucket 29 to permit horizontal movement of the bucket 29.

When the dragline 10 is digging, a tub 11 that sits on the ground supports the main housing 12. The main housing 12 is supported for pivotal movement relative to the tub 11 in a lateral plane about a vertical axis. A pair of walking mechanisms (not shown) moves the main housing 12 over the ground between digging operations. The main housing 12 includes an operator's cab 34 adjacent to and generally below the boom 24.

Figure 2:
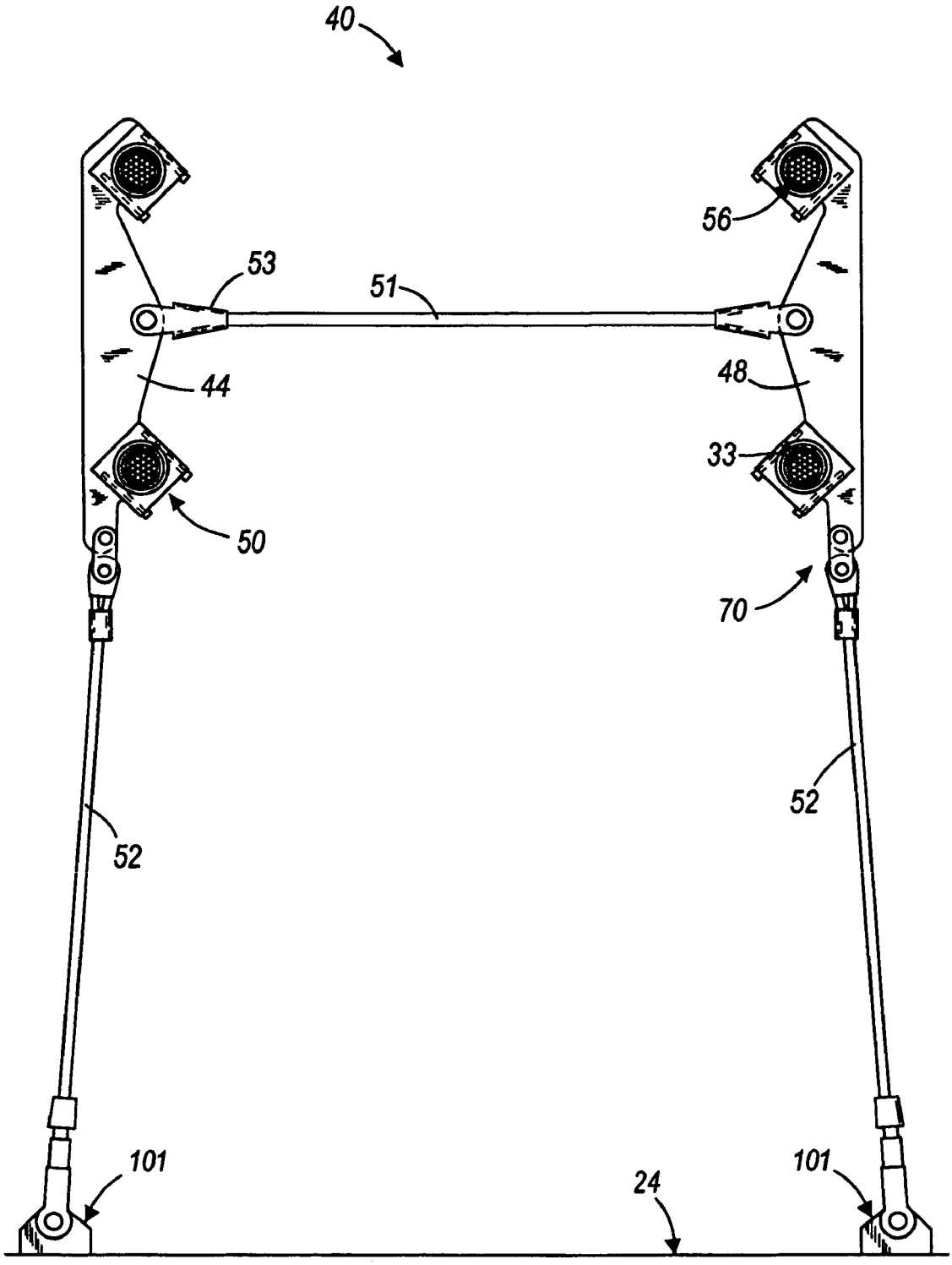
FIG. 2 is a side view of the boom support strand oscillation dampening mechanism taken along the line 2-2 in FIG. 1.

As illustrated in FIGS. 1 and 2, the dragline further includes a boom support strand oscillation dampening mechanism 40. The damping mechanism 40 is located 5/12 of the way down from the top of the boom 24, between the center 38 and upper 37 sections of the boom 24. As shown in FIG. 2, the dampening mechanism 40 includes a left brace 44, and a right brace 48 spaced apart from the left brace 44. Each brace is attached via a clamp mechanism 50 to a boom support strand 33. The left brace 44 is attached to two of the boom support strands 33, and the right brace 48 is attached to the other two boom support strands 33. A steel cable 51 extends between and is pivotally attached by retainers 53 to the left brace 44 and the right brace 48. The dampening mechanism 40 further includes two ropes, each of which extends between and is attached to each of the braces and the boom. The dragline 10 as thus far described is conventional.

Further, in the conventional damping mechanism, the rope extending between the braces and the boom is made of steel, and a clamp mechanism, without any intermediate bushing, holds the support strands. This invention constitutes an improvement to the above thus far described conventional damping mechanism.

Figure 3:
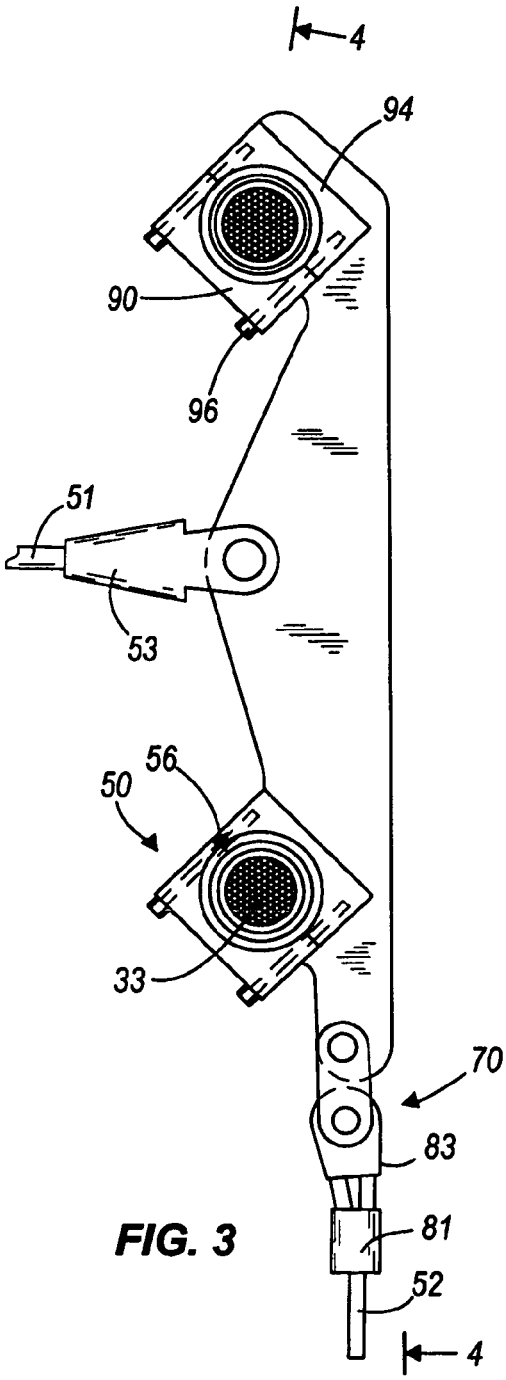
FIG. 3 is an enlarged side view of the right hand side of the dampening mechanism of FIG. 2.

More particularly, the dampening mechanism 40 of this invention comprises constructing a rope 52 that extends between the boom 24 and each brace out of a more stretchable material. In the preferred embodiment, the rope 52 is made out of polyester. And still more particularly, as shown in FIGS. 2, 3 and 4, the dampening mechanism 40 of this invention comprises a flexible enclosure or bushing 56 made of synthetic, flexible material, placed between the clamp mechanisms 50 and the support strands 33.

More particularly, the bushing 56 has a length, as measured from its midsection to either end of the bushing 56, of more than 2 times longer than the inside diameter of the bushing 56. More particularly, in the preferred embodiment, the bushing 56 has a length, as measured from its midsection 60 to either end of the bushing 56, of more than 3 times longer than the inside diameter of the bushing 56. Further, the bushing 56 is tapered down towards its ends from near its midsection 60, and the midsection is attached to its respective brace by the clamp mechanism 50. Still more particularly, the tapering is a result of the outer surface of the bushing including steps 64 (see FIGS. 4 and 5) of decreasing diameter as the outer surface leaves the bushing's midsection 60 and nears either end of the bushing 56. The clamp mechanism 50 holds the bushing 56 in the reduced midsection 60 between two steps, as shown in FIG. 4, and prevents the bushing 56 from being pulled out of the clamp mechanism 50.

The flexible bushing 56 is made of an elastomer toughened thermoplastic material and the clamp mechanism 50 is made of steel. More particularly, the bushing 56 is made of two components mixed together and cured, the two components comprising one component made of caprolactam and a prepolymer in the form of a polyl based on polyether, and the other component made of a curing catalyst and caprolactam. Still more particularly, the bushing 56 is made from Nyrim 3000 or Nyrim 2000, a trademarked material sold by Bruggemann Chemical.

Figure 4:
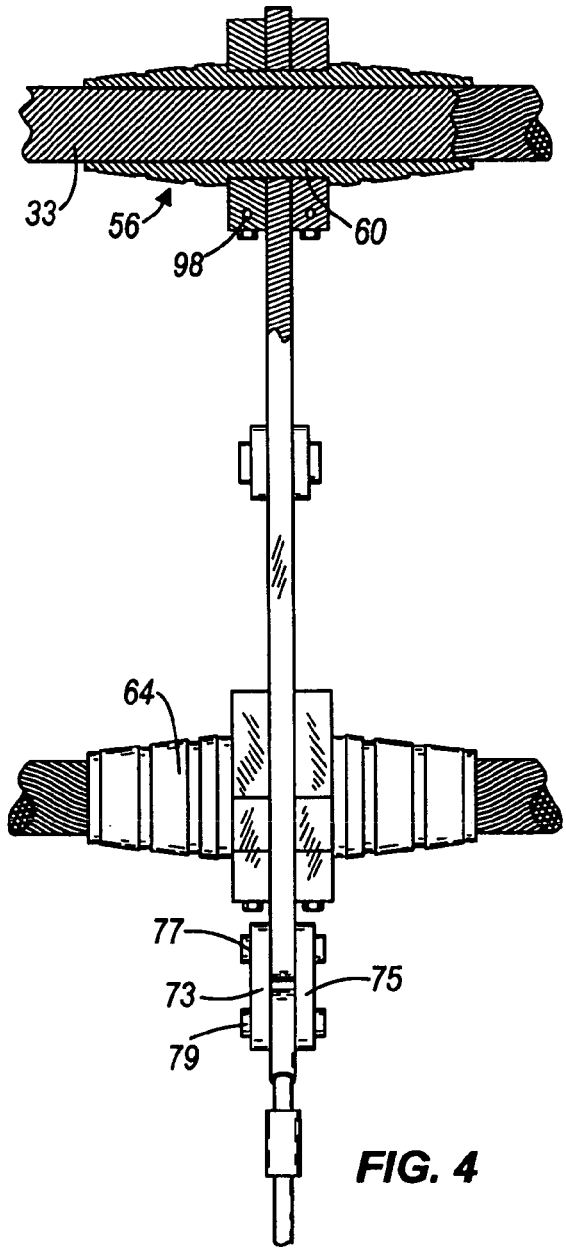
FIG. 4 is an end view, partially in section, of the portion of the dampening mechanism shown in FIG. 3, taken along the line 4-4 in FIG. 3.
Figure 5:
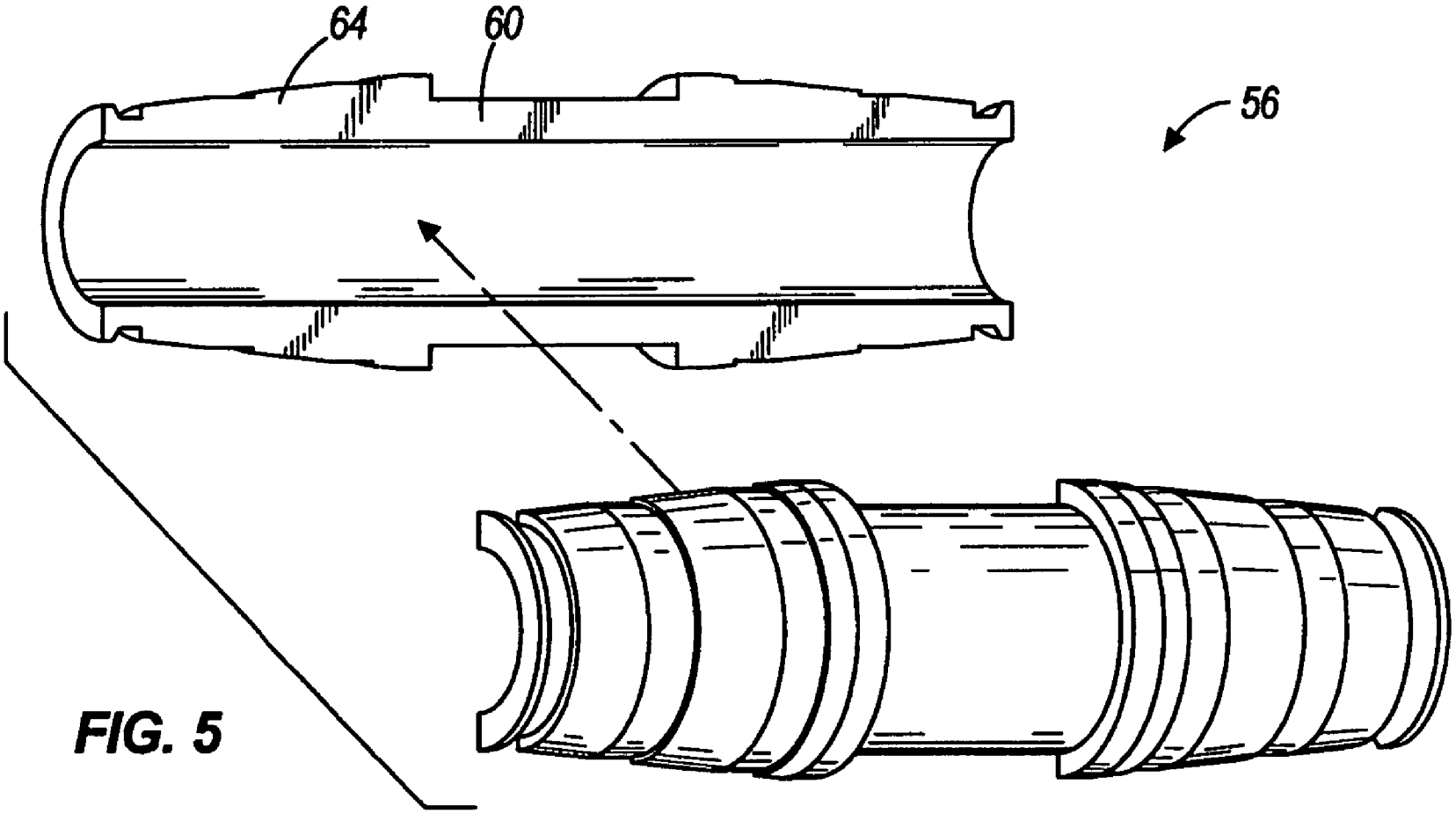
FIG. 5 is an exploded view of the flexible enclosure that surrounds the wire rope in FIG. 4.

Each bushing 56, as shown in FIGS. 4 and 5, is an elongated member, split into two halves. The two halves are held together by the clamp mechanism 50, which acts as an enclosure attaching means, as follows. Each clamp mechanism 50 includes a bottom clamp block 94 attached to its respective brace. The bottom clamp block 94 has a boom support strand receiving indentation therein, and the clamp mechanism 50 further includes a top clamp block 90 with a boom support strand 33 receiving indentation therein, attached to the bottom clamp block 94 by spaced apart machine screws 96 received in respective threaded bores 98 through the clamp blocks, so that the boom support strand 33 is clamped between the bottom clamp block 94 and the top clamp block 90.

The boom strand damping mechanism 40 of this invention further includes a device 70 for attaching each rope 52 to its respective brace, the rope attaching mechanism 70 comprising two spaced-apart parallel pivot plates 73 and 75, two spaced apart pin connections 77 and 79, one 77 of which pivotally attaches the pivot plates 73 and 75 to its respective brace.

The other pin connection 79 has the end of the rope 52 trained around the pin connection 79, and a rope stay 81 for securing the trained portion of the rope 52 around the pivot pin connection 79. The attaching device 70 further includes a cover 83 over the trained portion of the rope and between the stay 81 and the pivot plates 73 and 75.

The boom strand damping mechanism 40 also includes a mechanism 101 for pivotally attaching each rope 52 to the boom 24, as shown in FIG. 2.

Various other features and advantages of the invention will be apparent from the following claims.

The invention claimed is:

1. An apparatus including a main housing including a generally horizontal platform, a boom extending from the platform, a bucket suspended from the boom, a mast extending from the platform, a boom support strand extending between and attached to said mast and said boom, and a boom support strand oscillation dampening mechanism comprising a brace, a rope extending between and attached to said brace and said boom, and a boom support strand clamp mechanism connected to said brace and including a first clamp block, a second clamp block, a flexible enclosure placed between the first clamp block and the second clamp block, said boom support strand being within said flexible enclosure, said flexible enclosure having a length, as measured from its midsection to either end of the flexible enclosure, of more than 2 times longer than the inside diameter of the flexible enclosure, and means for holding said first clamp block to said second clamp block so that said flexible enclosure is clamped between said first clamp block and said second clamp block.

2. An apparatus in accordance with claim 1 wherein said flexible enclosure has a midsection attached to its respective brace by the clamp mechanism.

3. An apparatus in accordance with claim 1 wherein the flexible enclosure has a midsection and wherein said flexible enclosure is tapered down towards its ends from near its midsection.

4. An apparatus in accordance with claim 3 wherein said flexible enclosure includes steps of decreasing diameter as the outer surface leaves the flexible enclosure's midsection and nears either end of the flexible enclosure.

5. An apparatus in accordance with claim 1 wherein said flexible enclosure is made of synthetic material.

6. An apparatus in accordance with claim 5 wherein said flexible enclosure is made of an elastomer toughened thermoplastic material, and the clamp mechanism is made of steel.

7. An apparatus in accordance with claim 6 wherein the flexible enclosure is made of two components mixed together and cured, the two components comprising one component made of caprolactam and a prepolymer in the form of a polyl based on polyether, and the other component made of a curing catalyst and caprolactam.

8. An apparatus in accordance with claim 1 wherein said flexible enclosure is split into two identical halves and is held together by the clamp mechanism.

9. An apparatus in accordance with claim 1 wherein said flexible enclosure length, as measured from its midsection to either end of the flexible enclosure, is more than 3 times longer than the inside diameter of the flexible enclosure.

10. An apparatus in accordance with claim 1 wherein said rope is made of polyester.

11. An apparatus including a main housing including a generally horizontal platform, a boom extending from the platform, a bucket suspended from the boom, a mast extending from the platform, a mast support strand extending between and attached to said platform and said mast, a boom support strand extending between and attached to said mast and said boom, and a boom support strand oscillation dampening mechanism comprising a left brace and a right brace spaced apart from said left brace, a polyester rope extending between each of said braces and said boom, each of said ropes being attached to said boom, a device for attaching said rope to said brace, and a boom support strand clamp mechanism connected to said brace and including a first clamp block, a second clamp block, a flexible enclosure placed between the first clamp block and the second clamp block, said boom support strand being within said flexible enclosure, and wherein the flexible enclosure has a length, as measured from its midsection to either end of the flexible enclosure, of more than 2 times longer than the inside diameter of the flexible enclosure, and means for holding said first clamp block to said second clamp block so that said flexible enclosure is clamped between said first clamp block and said second clamp block.

12. An apparatus in accordance with claim 1 wherein said apparatus further includes a device for attaching said rope to said brace, said rope attaching device comprising two spaced-apart parallel pivot plates, two spaced-apart pin connections, one pivotally attaching said pivot plates to said brace, the other having the end of the rope trained around said pin connection, a rope stay for securing said trained portion of said rope around said pivot pin connection, and a cover over said trained portion of said rope and between said stay and said pivot plate.

13. An oscillation dampening mechanism adapted to be used with an apparatus including a generally horizontal platform, a boom extending from the platform, a bucket suspended from the boom, a mast extending from the platform, and a boom support strand extending between and attached to the mast and the boom, said oscillation dampening mechanism comprising a brace, a rope extending between and attached to said brace and said boom, and a boom support strand clamp mechanism connected to said brace and including a first clamp block, a second clamp block, a flexible enclosure placed between the first clamp block and the second clamp block, said boom support strand being within said flexible enclosure, said flexible enclosure having a length, as measured from its midsection to either end of the flexible enclosure, of more than 2 times longer than the inside diameter of the flexible enclosure, and means for holding said first clamp block to said second clamp block so that said flexible enclosure is clamped between said first clamp block and said second clamp block.

14. An oscillation dampening mechanism in accordance with claim 13 wherein said rope is made of polyester.

* * * * *